United States Patent [19]

MacDougall

[11] 4,240,631

[45] Dec. 23, 1980

[54] SHAFT ASSEMBLIES FOR GOLF CLUBS

[76] Inventor: Ian C. MacDougall, 19 Knockbreck Ave., Tain, Ross-shire, Scotland, IV19 1LY

[21] Appl. No.: 915,192

[22] Filed: Jun. 13, 1978

[30] Foreign Application Priority Data

Jun. 25, 1977 [GB] United Kingdom ..... 26705/77

[51] Int. Cl.[3] ..... A63B 53/00; A63B 53/12

[52] U.S. Cl. ..... 273/77 A

[58] Field of Search ..... 273/77 R, 77 A, 80 R, 273/80 B

[56] References Cited

U.S. PATENT DOCUMENTS

| | | | |
|---|---|---|---|
| 1,516,786 | 11/1924 | Prentiss | 273/77 A |
| 3,625,513 | 12/1971 | Ballmer | 273/77 A |
| 3,685,135 | 8/1972 | Letters | 273/80 B X |
| 3,871,649 | 3/1975 | Kilshaw | 273/77 A |
| 3,963,236 | 6/1976 | Mann | 273/77 A |

FOREIGN PATENT DOCUMENTS

| | | | |
|---|---|---|---|
| 1220804 | 1/1971 | United Kingdom | 273/77 A |

OTHER PUBLICATIONS

"The Search for the Perfect Swing", by Cochran and Stobbs, 1968, pp. 214–217.

*Primary Examiner*—Richard J. Apley

[57] ABSTRACT

A problem in golf club manufacture is the very large number of different shafts required to make sets of clubs with different shaft flex characteristics. The invention teaches how it is possible to greatly reduce the number of different shafts used in a set by defining the shaft flex characteristics in terms of the EI value of the shaft. Recognizing that the EI value at a section, that is, at a distance from a selected datum, controls the amount of deflection and hence flex characteristics the invention teaches how it is then possible to use a single member shaft throughout a set and by altering the distance from the datum, and hence altering the EI value, a second and a third set and so on, having flex characteristics different from the first set can be produced from identical master shafts or shaft blanks.

7 Claims, 8 Drawing Figures

| CLUB Nº | LIE ANGLE | EFFECTIVE LENGTH | CLUB Wt | EI VALUE AT 'P' | PROD MOM |
|---|---|---|---|---|---|
| 2 | 57° | 34·87 | 14·49 | 17,150 | 505 |
| 3 | 58° | 34·27 | 14·75 | 16,850 | 505 |
| 4 | 59° | 33·69 | 15·00 | 16,550 | 505 |
| 5 | 60° | 33·13 | 15·26 | 16,250 | 505 |
| 6 | 61° | 32·59 | 15·51 | 15,950 | 505 |
| 7 | 62° | 32·07 | 15·76 | 15,650 | 505 |
| 8 | 63° | 31·58 | 16·00 | 15,350 | 505 |
| 9 | 64° | 31·10 | 16·26 | 15,050 | 505 |
| 10 | 65° | 30·64 | 16·50 | 14,750 | 505 |

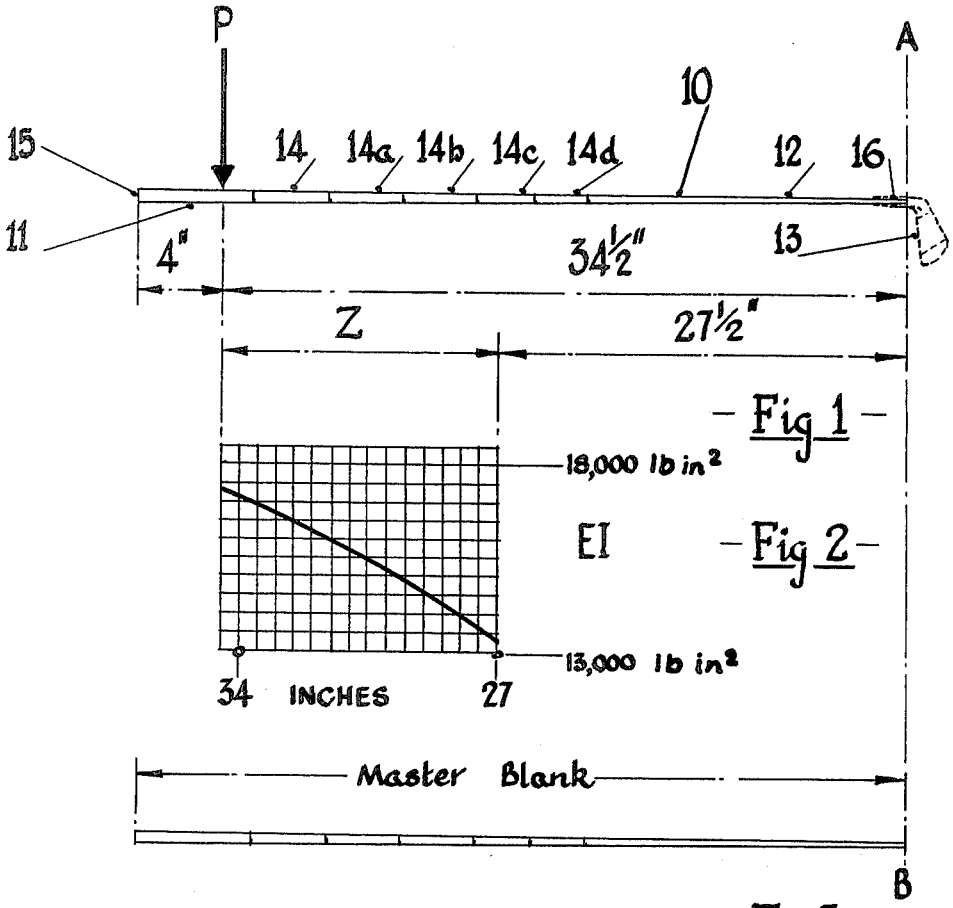
- Fig 1 -
- Fig 2 -
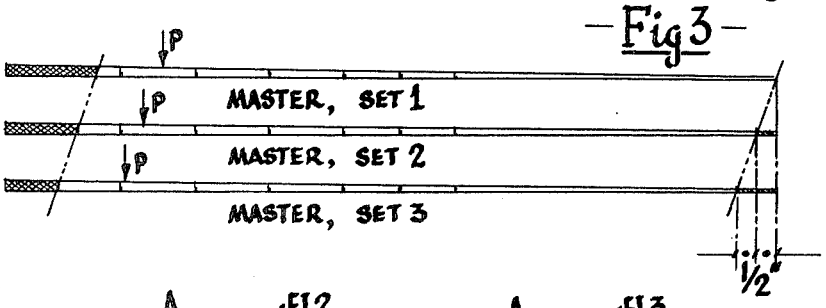
- Fig 3 -
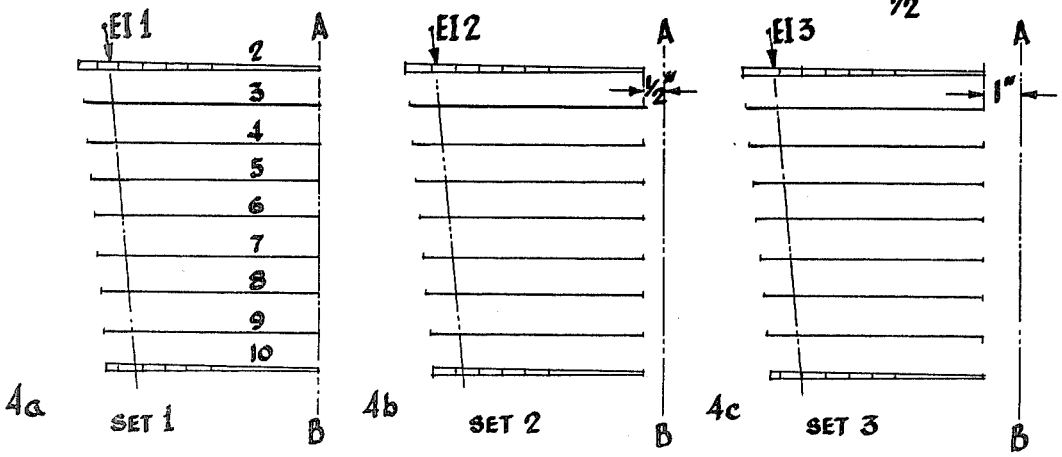
- Fig 4 -

| CLUB Nº | LIE ANGLE | EFFECTIVE LENGTH | CLUB Wt | EI VALUE AT 'P' | PROD MOM |
|---|---|---|---|---|---|
| 2 | 57° | 34·87 | 14·49 | 17,150 | 505 |
| 3 | 58° | 34·27 | 14·75 | 16,850 | 505 |
| 4 | 59° | 33·69 | 15·00 | 16,550 | 505 |
| 5 | 60° | 33·13 | 15·26 | 16,250 | 505 |
| 6 | 61° | 32·59 | 15·51 | 15,950 | 505 |
| 7 | 62° | 32·07 | 15·76 | 15,650 | 505 |
| 8 | 63° | 31·58 | 16·00 | 15,350 | 505 |
| 9 | 64° | 31·10 | 16·26 | 15,050 | 505 |
| 10 | 65° | 30·64 | 16·50 | 14,750 | 505 |

SHAFT ASSEMBLIES FOR GOLF CLUBS

This invention relates to golf club manufacture. More particularly the invention is concerned with the provision of matched sets of golf clubs in a particularly expeditious manner through the use of a common master shaft or shafts or shaft blanks of similar or same design. In this specification the phrase "a set of golf clubs" is taken to mean a group of golf clubs correlated to provide matched playing characteristics.

A known and continuing problem in golf club manufacture is the large number of different shafts required to provide the necessary range of flexes demanded by the market. Understandably the large range to be stocked constitutes a real problem for the manufacturer. In one patent, for example, U.K. Pat. No. 1,246,539 it is said the total stock of shafts required for a range of different clubs may be in the range of two to five million.

Of course, attempts have been made to solve this problem. The patent mentioned above seeks to solve this problem by providing a golf club shaft which terminates in a hollow cylinder of substantially constant wall thickness. Desired flexibility characteristics may then be imparted, according to the patent, by severing a selected amount of the cylinder. In other words it would appear that a parallel tip portion is provided and shafts having different shaft flexibilities are said to be provided simply by cutting off different lengths of the parallel tip. This particular solution may indeed alleviate the stockist problem but it restricts the manufacturer to the use of a parallel tip shaft whereas a great many manufacturers prefer to use shafts with a tapered tip because a more efficient joint may be achieved with a tapered tip. A further attempt to solve the problem is disclosed in U.K. Pat. No. 1,262,896 where it is said some 156 different stock shafts are required. This patent seeks to solve the problem by providing a common shaft blank from which portions can be cut from either the handle end portion or the head end portion so that shafts having the required shaft flex characteristics may be provided. Again, however, this solution would appear to be limited to the use of a shaft having a head end of a uniform cross section. Moreover, this patent introduces a further problem common in golf club manufacture when it specifies different flex characteristics as being either a number 1, 2, 3 or 4 flex. Apart from the fact that a No. 1 flex is indicated to be the stiffest and a No. 4 flex is indicated to be the most flexible no further definition of flex characteristic is offered.

It is believed that this lack of information on what constitutes flex characteristics is also a problem in golf club manufacture and this invention will address itself also to the problem of providing more definitive methods of specifying and identifying so called flex characteristics. For example, perhaps the most widely used method to classify shaft flex is the so called 'deflection' method. This method comprises supporting a club cantilever fashion, applying a known load and noting the deflection. Applying this procedure to classifying in a well known if not all that useful a range, namely stiff, medium, and whippy the following might pertain. Suppose under a load of two pounds one club deflected one inch, another club deflected two inches and a third club deflected three inches, then it would be said the first club was stiff, the second was medium and the third whippy. Similarly three other clubs might deflect $1\frac{1}{2}$, $2\frac{1}{2}$ and $3\frac{1}{2}$ inches respectively under the same two pounds load so that again they might be classified as stiff, medium and whippy whereas it is quite clear from this that the flex characteristics for these two lots of clubs must be quite different.

In seeking to provide a more standardised method of classifying or specifying shaft flex characteristics this invention proposes to utilise a concept based on the 'EI' value of the shaft. The symbol 'E' defined, for example, in Machinery's Handbook 18th Edition, page 351, published by Industrial Press Inc. denotes the property known as Young's Modulus and is the property of a material which gives a guide to how much the material will yield under load. The symbol 'I', defined, for example, in Machinery's Handbook, 18th Edition, see pages 353 and 367, published by Industrial Press Inc. denotes the moment of resistance to bending and its value depends on how the material is distributed or shaped, that is on the dimensions of the section concerned. For example, for the material steel of which most golf club shafts are made, the value of 'E' is equal to $30\times10^6$ lbs per square inch. For a golf shaft which is a circular tubular shape the value of 'I' at any section is given by the formula $(\pi/64)(d_1^4-d_2^4)$ where $\pi$ is the constant 3.142, $d_1$ is the outside diameter and $d_2$ is the inside diameter of the section concerned.

Since 'I' pertains to a particular section of the shaft then all values must be taken relative to a particular position on the shaft. According to this invention it is preferred to take all measurements relative to a point four inches from the butt end of the grip portion of the shaft. The reason for this is that this point, hereafter referred to as the operating point, is, or near enough is, the centre point of the golfer's grip on the club. In other words it is near enough, in most cases, the centre point of the golfer's hand position on the club. Furthermore, according to this invention it is proposed to have a steadily reducing EI value at the operating point as the clubs get shorter. This is in contrast to conventional sets of clubs where the EI value increases as the shafts get shorter. The reason for this is that conventional sets of clubs are made up from groups of shafts and a typical grouping would be 2 and 3, 4 and 5, 6 and 7, 8 and 9 and so on. These groups are made from shaft blanks which in turn have been made from a similar steel billet or other material. Consequently the same weight or volume of material goes into the making of each shaft in the group. Thus if the billet starts off with a diameter 'd' and is then drawn out or rolled to length the increase in length can only be at the expense of reducing the wall thickness of the shaft. Consequently as the shafts get longer the wall thickness must reduce and hence the EI value must also reduce. Conversely it can be said that the EI value increases as the conventional shafts get shorter.

An object of this invention is to provide a matched set of golf clubs from substantially identical shaft blanks.

A further object is to produce a matched set of golf clubs where the shafts have a steadily reducing EI value.

Accordingly a first aspect of the invention comprises in a set of golf clubs, each said golf club including a tapered handle portion and a tapered tip portion for the attachment of a golf club head thereto, each said golf club further comprising a total weight and an effective length, the improvements comprising (a) each said shaft is made from substantially identical shaft blanks, (b) the product of said effective length multiplied by said total weight is kept substantially the same for each club in the set and (c) the shafts in said set have a steadily reducing EI value from the longest to the shortest club, said EI values occuring on each shaft on said tapered handle portion at a point a predetermined distance from the end of said handle portion.

The invention will now be described with the aid of the undernoted drawings which description is by way of being an example only of the invention and no limitation thereon is implied or intended.

FIG. 1 is a diagrammatic illustration of a shaft useful to practise the invention.

FIG. 2 is a graph showing the distribution of the EI value of the shaft of FIG. 1.

FIG. 3 is a diagrammatic illustration of three shafts made from identical shaft blanks.

Figures 5, 6:
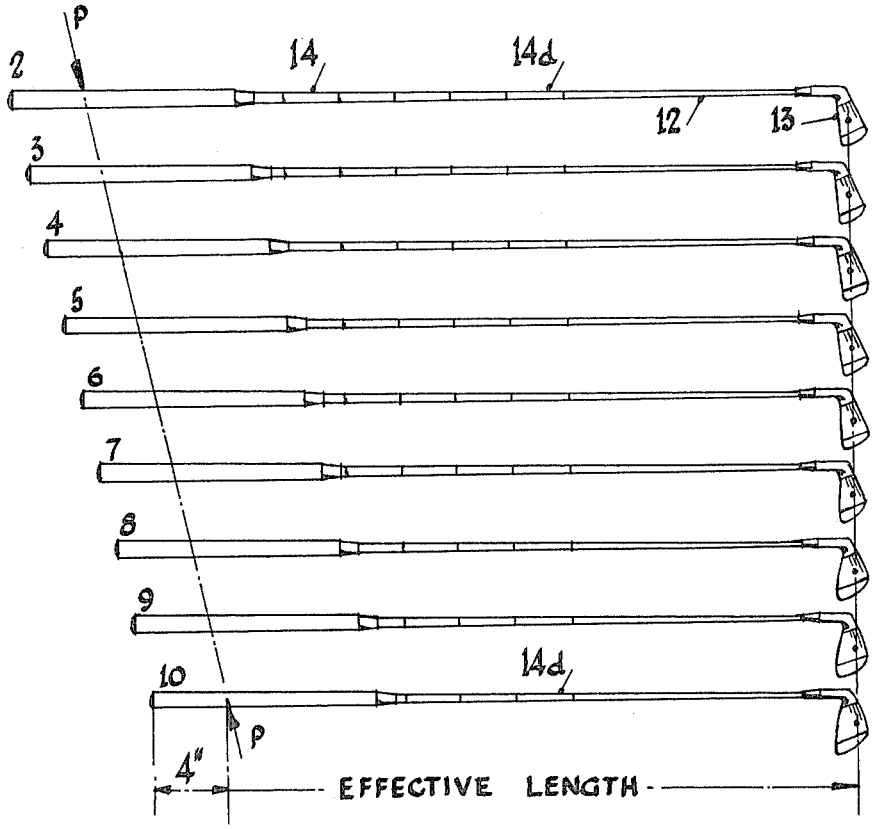

FIGS. 4*a*, 4*b* and 4*c* show how three sets of clubs can be made from the shafts of FIG. 3.

FIG. 5 is an illustration of a set of clubs made in accordance with the invention.

FIG. 6 is a table setting forth characteristics of the clubs of FIG. 5.

A shaft or shaft blank 10 useful in the practice of the invention is shown in FIG. 1. This is seen to comprise a grip end portion 11, a head end portion 12 to which a golf club head 13 (shown dotted) will be attached and intermediate portions 14, 14*a*, 14*b*, 14*c* and 14*d* therebetween. The shaft blank can comprise a stepped taper, a stepped parallel, a straight taper or any combination thereof and in this specification the phrase "tapered handle portion" includes a handle portion with parallel outside diameter where variations in EI value is achieved by variation in wall thickness. It is preferred that the head end portion 12 be tapered since it is believed a more efficient joint can then be obtained between the club head and the shaft. Also a tapered shaft throughout, stepped or plain, is preferred because of the very large and smooth variation in the EI value. The operating point is shown four inches from the butt end 15 which, of course, has the greatest EI value.

Now the length of the blank is shown as 38½ inches and the maximum and minimum lengths of iron shafts are of the order of 37 and 31 inches respectively. It will thus be appreciated that there will be a zone of operating points covering a range of EI values which can be utilised to provide sets of golf clubs with various predetermined flexibility characteristics. It should also be appreciated that to avoid difficulties in fitting the club head to the shaft it is desirable to keep the tip portion 16, that is the portion which fits inside the head, to keep this the same taper throughout a particular set. For this reason all lengths are measured back from a datum A-B which from FIG. 3 is seen to be the point of insertion of the tip into the head 13.

FIG. 2 depicts the variation in EI values exhibited by a shaft used to practise the invention. As can be seen the maximum EI value occurs at the butt end 15 reducing to a minimum at the tip end. The important part of the graph, however, is the operating zone Z because it is the EI values within this zone which will serve to establish the flex characteristics and hence identify a particular set of clubs. The range of values in this zone for this shaft will be of the order of 18,500 to 13,000 lbs ins$^2$ units. However, for shafts in general and including woods and iron shafts the total range will be greater and will be of the order of 22,000 to 12,000 lbs ins$^2$ units.

FIG. 3 taken with FIGS. 4*a*, 4*b* and 4*c* illustrate diagrammatically how three sets of clubs each having different flex characteristics can be made in accordance with the invention. It is emphasised however, three sets are chosen simply to illustrate the invention and, in fact, a range of sets, each set having different flex characteristics can be provided.

Taking the longest iron for the purpose of this description as the No. 2 iron, the prescribed length is determined and is marked off on the master shaft blank from the datum line A-B. After cutting or otherwise separating the blank at the prescribed length the resulting shaft will have a certain EI value at a point four inches from the butt end of the shaft and which value has been determined prior to the shaft cutting procedure. Thereafter, a set of clubs starting with this No. 2 iron can be produced as shown in FIG. 4 and as can be seen the line sloping downwards from left to right through the operating points is an indication of a steadily reducing EI value. Another shaft blank exactly the same, within manufacturing tolerances, is then taken and the length of the No. 2 for this particular set (again which will have previously been determined) is set off on the blank. This time, however, the length is marked off from a point stepped back from the datum line A-B and in the example shown this step is ½ inch or equivalent. Thereafter, the set of shafts starting with the No. 2 iron shaft for the second set of clubs is cut to length as shown in FIG. 4*b* and the procedure followed through as for the first set. The third set is made up by taking a third master shaft blank, the same as the first two, again within manufacturing tolerances, and setting off the length for the No. 2 iron for this set. This time the distance stepped back is one inch from the datum line A-B. Thereafter, the same procedure is followed to provide a set of shafts for the third set of clubs.

This procedure clearly shows the versatility of the system because obviously the stepbacks are not limited to ½ inch or one inch but can be varied a great deal. For example, if the shaft blank is 38½ inches long and the maximum and minimum lengths of iron shafts are 37 and 31 inches respectively, and assuming the width of cut to be one sixteenth of an inch then the minimum number of EI values available would be 1½ inches divided by one sixteenth, namely 24. Clearly by varying the width of cut the range could be increased considerably, and, moreover, different master shaft blanks could be used. It will be clear from the above that there will be a range of EI values available so that for volume or standard production it is possible to provide sets of clubs having different flex characteristics for a selected specification. On an individual basis a good pointer to selecting the appropriate EI value is to check the player's favourite club since usually a player has a propensity to pick as his favourite club the one with flex and weight characteristics most suited to his particular swing.

In practise it has been found advantageous to use one master shaft for the woods and a different master shaft for the irons. It should be appreciated that for any set of clubs or group of clubs, not necessarily a full set, using one master shaft throughout the set means that the weight per unit length of each shaft in the set will be the same. A preferred shaft used to practise the invention for the production of woods has a weight per unit length of 0.09831 ozs per inch while a preferred shaft used in the production of irons has a weight per unit length of 0.11028 ozs per inch. These are examples only and it will be understood that a variety of shafts could be used as master shafts. For example, a 44 inch shaft weighing 4.4 ozs would be 0.1 ozs per inch whereas a 44 inch weighing 2.5 ozs would be 0.05682 ozs per inch. Obviously each shaft would be capable of being used as a master shaft for the production of golf clubs as described herein.

FIG. 5 illustrates a set of golf clubs made in accordance with the invention and comprising the Nos. 2 to 9 irons although as pointed out elsewhere the invention is equally applicable to the production of woods. Where the master shaft or blank has a distinctive or regular pattern of steps, these will manifest themselves in a regular step pattern throughout the set. As will be seen from FIG. 5 there will be parallelism with a datum such as the end of the shaft or the heel of the club head. Also it will be clear the step pattern will not be entirely repeated because of the shortening of the clubs in the set.

A further aspect of the invention which facilitates the matching of club to club within a set and, indeed which facilitates the distinguishing or identifying one set of clubs relative to another set of clubs will now be described. It has been found that making the product of total weight of club multiplied by the effective length a constant within a set greatly facilitates the matching of one club to another club within a set. More particularly the product is total weight times effective length where effective length is defined herein as the total length minus four inches. In other words the effective length is the length of the club measured from the operating point to the centre of gravity of the club head as will be clear by referring to FIG. 5. By maintaining this 'product moment', that is, effective length times weight, a constant from club to club and combining this with the requisite flex characteristics as defined by the EI values it is possible to produce a set of clubs having a particular 'feel'. Also by changing the values of the various parameters it is possible to produce sets of clubs having a different 'feel'. 'Feel', of course, is a very difficult term to define and perhaps the most infallible method is to allow players to try out the club in use and depending on the player's skill, ability and reputation greater or less cognizance has to be taken of the opinion expressed. Interestingly a set of golf clubs made in accordance with this invention has been pronounced as having the same 'feel' from club to club in the set when tested in actual play.

I claim:

1. In a set of golf clubs, each said golf club including a tapered handle portion and a tapered tip portion for the attachment of a golf club head thereto, each said golf club further comprising a total weight and an effective length, the improvements therein comprising:

(a) each said shaft is made from substantially identical shaft blanks, (b) the product of said effective length multiplied by said total weight is kept substantially the same for each club in the set, (c) the flexibility of the shafts in said set being determined by a preselected EI value, said EI value steadily reducing from the longest to the shortest club, said EI values occurring on each shaft on said tapered handle portion at a point a predetermined same distance from the end of said handle portion whereby said clubs are provided with matched playing characteristics, and (d) each said shaft in said set has the same tip diameter.

2. A set of golf clubs according to claim 1 wherein said same distance is substantially four inches and said effective length is measured from said point to the centre of gravity of the head.

3. A set of golf clubs according to claim 1 wherein said tapered tip portion of each shaft has substantially the same rate of taper for entering into said head a predetermined substantially equal distance from the centre of gravity of said head.

4. A set of golf clubs according to claim 1 wherein said shaft blank has a regular step pattern and wherein said regular step pattern appears in said set parallel with a predetermined datum, and wherein said datum is part of the golf club head.

5. A set of golf clubs according to claim 4 wherein the first step of said regular step pattern appears on each shaft at the same distance from said predetermined datum and wherein said datum is the centre of gravity of the head.

6. A set of golf clubs according to claim 1 wherein the tapered tip portion of each shaft extends into the club head such that the tip of the shaft is a predetermined same distance from the centre of gravity of the head.

7. A set of golf clubs according to claim 1 wherein the shafts include a number of stepped portions and wherein the steps form a parallel pattern with the first step on each shaft occurring at the same distance from a predetermined common datum on each head.

* * * * *